US005367842A

United States Patent [19]

Janesky

[11] Patent Number: 5,367,842

[45] Date of Patent: Nov. 29, 1994

[54] FLOOR-WALL JOINT ENCLOSURE FOR BASEMENT WATER-CONTROL SYSTEMS

[76] Inventor: Lawrence Janesky, 1 Clayton St., Milford, Conn. 06460

[21] Appl. No.: 73,177

[22] Filed: Jun. 8, 1993

[51] Int. Cl.[5] ..... E02D 27/00

[52] U.S. Cl. ..... 52/169.5

[58] Field of Search ..... 52/287, 288, 290, 169.5, 52/389

[56] References Cited

U.S. PATENT DOCUMENTS

| | | | |
|---|---|---|---|
| 3,304,672 | 2/1967 | Bakke | 52/287 R X |
| 3,344,569 | 10/1967 | Cotten | 52/287 R |
| 4,845,910 | 7/1989 | Hanson et al. | 52/287 R |
| 5,199,232 | 4/1993 | Chandler et al. | 52/169.5 |

FOREIGN PATENT DOCUMENTS

| | | | |
|---|---|---|---|
| 2846717 | 5/1979 | Germany | 52/389 |

*Primary Examiner*—Carl D. Friedman
*Assistant Examiner*—Creighton Smith
*Attorney, Agent, or Firm*—Perman & Green

[57] ABSTRACT

A plastic water-conveying elongate enclosure for confining admitted groundwater adjacent the wall-floor joint around the inner periphery of a basement or other subterranean room. The invention relates to a novel undersurface of the enclosure comprising spaced longitudinal dovetailed or flanged ribs and grooves which provide improved receptivity, distribution and retention of bonding adhesive, used to bond the enclosure to the floor.

2 Claims, 2 Drawing Sheets

FIG. 1.
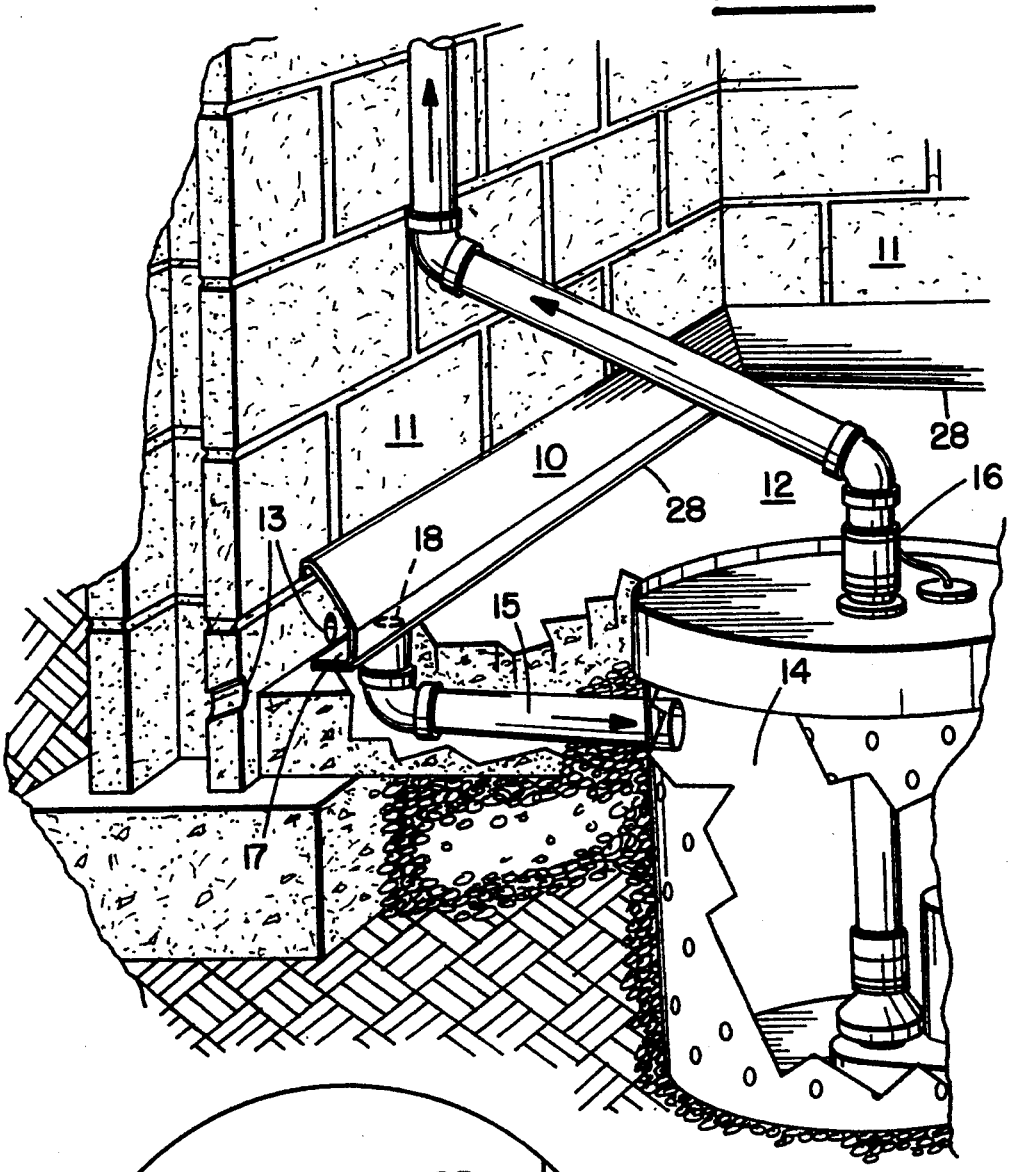
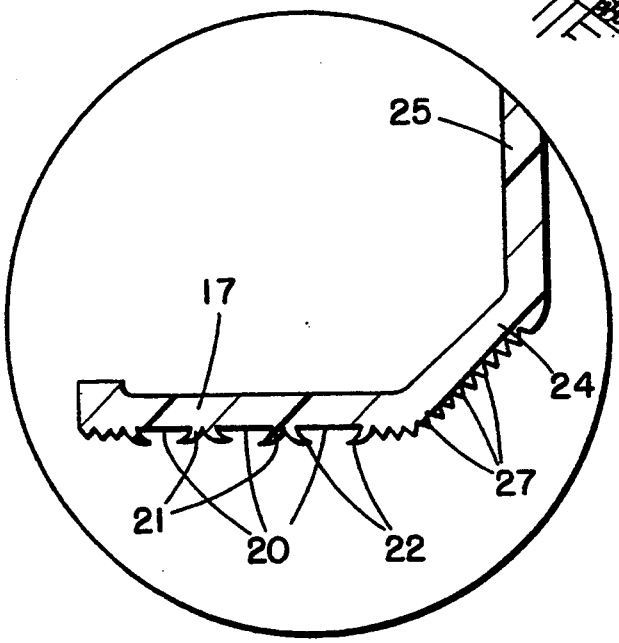
FIG. 3.

FLOOR-WALL JOINT ENCLOSURE FOR BASEMENT WATER-CONTROL SYSTEMS

BACKGROUND OF THE INVENTION

1. Field of the Invention

The present invention relates to improvements in baseboard water-control systems for admitting, channeling, collecting and expelling ground water from basements or other subterranean rooms having walls and a floor. The problems caused by the invasion of ground water into basements and other structures are numerous. Generally such water seeps into basements from the walls and perimeter of the floor at the floor-wall joints, due to external hydrostatic pressures of water in the ground.

2. State of the Art

According to a conventional baseboard water control system, a plurality of weep holes are drilled into the floor along the area of the floor-wall joint if the walls are poured concrete, or into the block walls if they are hollow core masonry block walls, around the inner periphery of a basement or other subterranean room, to admit any exterior groundwater accumulation as it occurs and prevent the build-up of hydrostatic pressure. Then a continuous, flexible, plastic, water-channelling baseboard enclosure is bonded to the surface of the floor to enclose the floor-wall joint around the inner periphery of the room, to control the admitted ground water and channel and drain it into a collection location, such as a sump pump reservoir, from which it is pumped automatically to an exterior drain.

Such water-control systems produce excellent results but their effectiveness is dependent upon the integrity of the plastic baseboard water-channeling enclosure and its bond with the supporting floor. Unless said bond, generally by means of an epoxy resin, is and remains a continuous water-barrier, the intentionally-admitted ground water will present greater problems than if the system was not installed in the first place.

SUMMARY OF THE INVENTION

The present invention relates to a plastic water-channeling baseboard enclosure, for use in conventional baseboard basement water-control systems, designed to provide improved bonding properties with respect to a cement floor. By bonding properties is meant the ability of the underside of the base of the enclosure (a) to entrap the bonding adhesive within longitudinal channels between dovetailed locking ribs therein, and (b) to cause the adhesive to flow along and fill said channels when the enclosure is pressed down against the bonding adhesive, to form continuous longitudinal beads of bonding adhesive between the enclosure base and the supporting floor, and (c) to integrate continuous diverting or dovetailed locking ribs into the bonding cement to produce an exceptionally strong, separation resistant bond between the floor, the hardened or cured bonding adhesive and the plastic water-channeling enclosure. Thus, the novel design produces substantial improvements over conventional plastic water-channeling enclosures having a substantially smooth undersurface which does not retain substantial amounts of adhesive cement, does not channel the bonding adhesive along the length of the enclosure but rather displaces it evenly in all directions when pressed thereagainst, and which does not contain any integration means for locking into the hardened or cured adhesive cement, such as of epoxy resin.

The novel design of the present water-channeling enclosures, according to a preferred embodiment of the present invention, also provides a chamferred wall section, adjacent the floor, as part of the design of the baseboard enclosure, providing a recess to receive and retain a continuous bead of adhesive material to improve the appearance of the installation, to protect the integrity of the watertight seal and to protect from external forces applied along the floor surface. The chamferred wall section has a longitudinally grooved exterior surface, in the area of the recess, which increases the resistance of the applied adhesive composition against displacement.

THE DRAWINGS

FIG. 1 is a diagrammatic illustration of a continuous, plastic water-channeling enclosure according to the present invention as a component of a baseboard basement water-control system;

FIG. 3 is an enlarged cross-sectional view of the base area of the water-conveying baseboard enclosure including the significant dovetail groove design and chamferred edge of the baseboard of FIG. 2.

DETAILED DESCRIPTION

Figure 2:
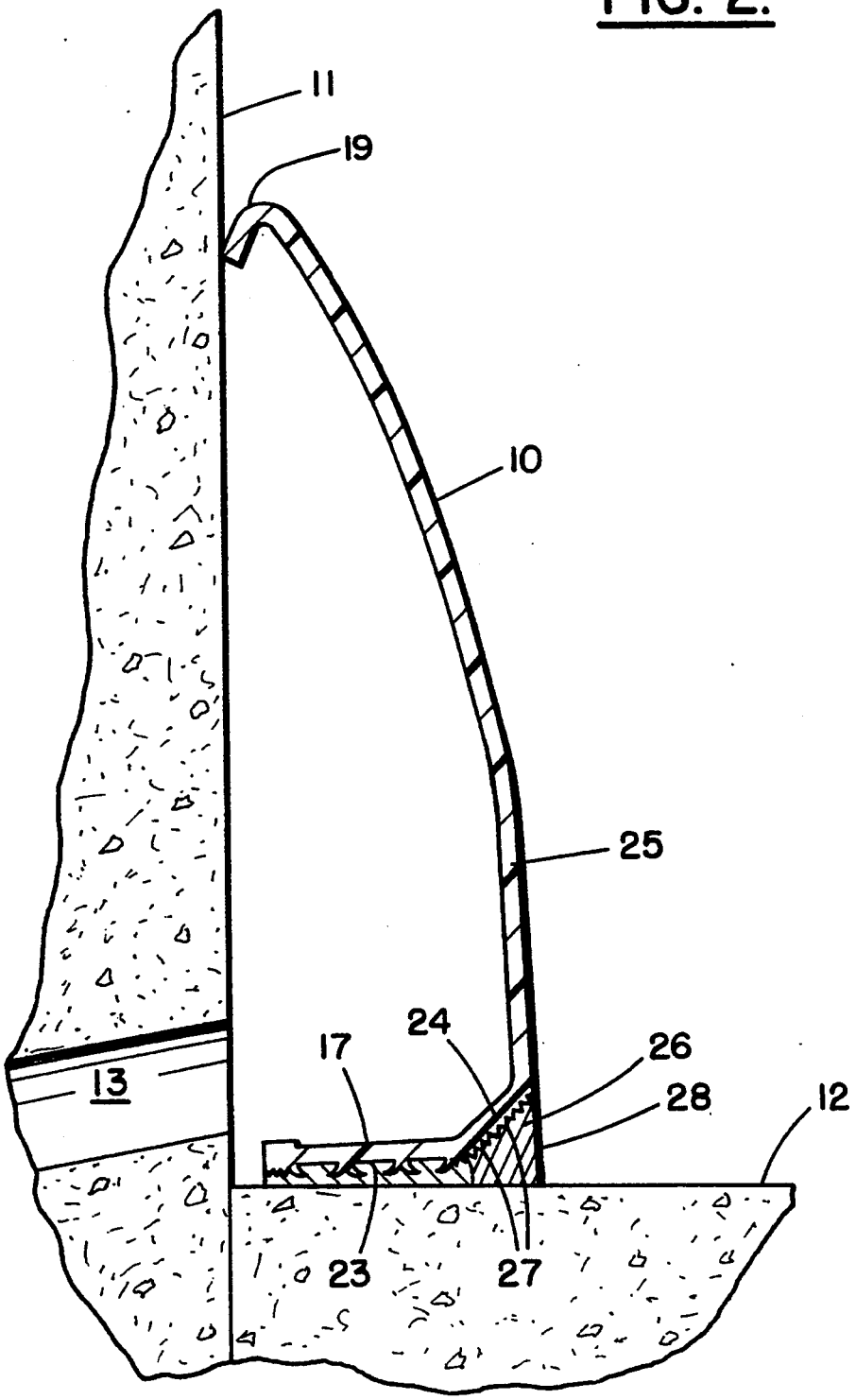
FIG. 2 is a vertical cross-section of a plastic water-channeling enclosure according to a preferred embodiment of the present invention, illustrated in installed position.

Referring to FIG. 1, the present plastic water-channeling enclosure 10 is illustrated in installed position adjacent the joint of the wall 11 and the floor 12 around the periphery of a basement or other subterranean room. Prior to installation of the enclosure 10, a plurality of evenly-spaced bore holes 13 are drilled downwardly and outwardly through the wall 11, adjacent the joint with the floor 12 to admit groundwater through the wall and prevent the build-up of hydrostatic pressure. If the walls are of poured concrete, the holes are drilled into the floor against the wall. Also, a sump pump and reservoir 14 and an enclosure drain conduit 15 are installed beneath the floor 12, the sump pump having a discharge conduit 16 which opens to a suitable exterior drain location. The water-channeling enclosure 10 has a base portion 17, the undersurface of which is bonded to the floor 12, and the base portion is provided with a drain opening 18, shown by means of broken lines, in the area overlying the drain conduit 15, to permit the groundwater admitted into the peripheral enclosure 10 to be channeled to the location of the drain opening 18 and to flow therefrom to the pump reservoir 14 from which it is pumped through conduit 16 whenever the water accumulation reaches a pump-activation level. As illustrated more clearly by FIG. 2, the enclosure 10 is only bonded to the floor surface. The upper edge 19 of the enclosure 10 is tapered downwardly and inwardly and makes pressure-contact with the wall surface 11, which permits any water on the upper parts of the wall to flow down into the enclosure 10. No bonding is required at the upper edge since the level of groundwater admitted to the enclosure 10 is generally maintained low by the drainage of the enclosure 10 through drain opening 18 into the sump pump reservoir.

Referring to FIG. 2, the undersurface of the base 17 of the water-conveying enclosure 10, shown in greater detail in FIG. 3, has a plurality of recessed longitudinal dovetailed grooves 20 formed between a plurality of longitudinal raised ribs 21, each having laterally-extending elongate lips, fingers or flanges 22 which extend partially into and overlie the grooves 20 to form retainer means for bonding adhesive 23 which is integrated into the grooves 20 and hardened to encase the flanges 22. The ribs 21 preferably have a T-, Y- or V-cross-section to provide the opposed or diverging flanges 22.

An advantage of the longitudinal continuous grooves 20, along the entire length of the undersurface of the enclosure 10, is that they receive and confine the flowable bonding adhesive and cause it to flow along and fill the length thereof with a continuous bead of the adhesive when the enclosure 10 is pressed against a wide line of the cement applied to the floor surface, adjacent the wall.

An advantage of the elongate lips, fingers or flanges 22 is that they provide continuous gripping means extending transversely into the grooves 20 to integrate with the bonding adhesive. The hardened or cured bonding cement 23 envelops the flanges 22 and locks the enclosure 10 to the cement floor 12, which normally comprises a semi-porous concrete surface having good bonding properties to the bonding cement 23. Thus, even if the plastic surface of the enclosure 10, at the base of the grooves 20, has weaker bonding properties for the cement, the hardened cement 23 cannot release from the grooves 20 because the opposed, diverging lips, fingers or flanges 22 form a narrowed exit opening through which the hardened bonding cement 23 in the grooves 20 cannot release.

Another novel feature of the present water-conveying enclosures 10, as illustrated by FIGS. 2 and 3, is the downwardly, inwardly-tapered wall section 24 connecting the side wall 25 to the base 17 of the enclosure 10 and forming a recess 26 between the bottom of the side wall 25 and the floor 12 around the entire outer periphery of the enclosure 10.

The outer surface of the wall section 24 is formed with a plurality of narrow longitudinal ridges 27 which provide a gripping surface or rough integration surface for a bead 28 of caulking composition which is after-applied around the entire outer periphery of the enclosure 10. Bead 28 provides a finished appearance to the installation by streamlining the surface of the enclosure 10 to the floor 12, and further shields the bonding cement 23 against forces applied along the floor surface.

Suitable bonding cements 23 are well known for use in conventional basement waterproofing systems. Preferred are curable epoxy resin compositions which are mixed on site and harden within a few hours to form a strong bond between most surfaces.

The present plastic water-conveying enclosures 10 preferably comprise polyvinyl chloride (PVC) which is extruded in desired lengths using dies designed to form enclosures 10 having the desired cross-section, such as shown in FIG. 2. In installations where abutting enclosure sections or lengths are joined together, and/or at corner areas where mating sections must be cut, such as at 45°, and joined to form leak-resistant connections, it is conventional to use continuous beads of the bonding cement, such as epoxy resin, around the entire periphery of the mating surfaces to prevent water leakage from the bonded joints.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An elongate, plastic water-conveying enclosure designed to be adhered to the floor of a subterranean room having a vertical wall, a floor and floor-wall joint around the inner periphery of the room, adjacent said floor-wall joint, to receive, confine and channel groundwater to a predetermined drain location, said enclosure comprising a narrow elongate horizontal base wall having an undersurface designed to be adhered along said floor, adjacent said vertical wall, and an elongate side wall which extends upwardly and inwardly from the base wall to contact said vertical wall and enclose said floor-wall joint, characterized by the undersurface of said elongate base wall comprising a plurality of closely-spaced, continuous longitudinal dovetailed ribs extending outwardly therefrom and forming therebetween a plurality of continuous longitudinal grooves for receiving and distributing flowable, curable, bonding adhesive, said outwardly-extending longitudinal dovetailed ribs comprising opposed, continuous, laterally-extending, outer surface flanges which overlie and narrow the entrance areas of said longitudinal grooves and integrate with the bonding adhesive within said grooves to prevent the separation of said enclosure from the bonding adhesive, said elongate side wall having a substantially vertical wall portion and a lower, narrow, substantially flat wall portion which tapers downwardly and inwardly from the vertical wall portion to the horizontal base wall to form an external recess adjacent the floor, the outer surface of the enclosure in the area of said flat wall portion being roughened to improve its adhesion to caulking compositions.

2. An enclosure according to claim 1 in which said longitudinal ribs have a T- Y- or V- cross-section to provide said opposed surface flanges.

* * * * *